US011388501B2

(12) United States Patent
Austen

(10) Patent No.: US 11,388,501 B2
(45) **Date of Patent: *Jul. 12, 2022**

(54) EARPIECE WITH ACTUATOR

(71) Applicant: ZOKU LIMITED, Birmingham (GB)

(72) Inventor: Simon Austen, Staffordshire (GB)

(73) Assignee: ZOKU LIMITED, Birmingham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/930,939

(22) Filed: Jul. 16, 2020

(65) Prior Publication Data

US 2021/0006885 A1 Jan. 7, 2021

Related U.S. Application Data

(63) Continuation-in-part of application No. 16/329,427, filed as application No. PCT/GB2017/052534 on Aug. 31, 2017, now Pat. No. 10,757,497.

(30) Foreign Application Priority Data

Sep. 1, 2016 (GB) ..... 1614883

(51) Int. Cl.
*H04R 1/10* (2006.01)
*H04R 17/00* (2006.01)

(52) U.S. Cl.
CPC ..... *H04R 1/1016* (2013.01); *H04R 1/1075* (2013.01); *H04R 17/00* (2013.01);
(Continued)

(58) Field of Classification Search
CPC ..... H04R 1/10; H04R 1/1016; H04R 1/105; H04R 1/1066; H04R 1/1091; H04R 1/24; H04R 25/00; H04R 25/02; H04R 25/60; H04R 25/604; H04R 25/607; H04R 25/65; H04R 25/652; H04R 2201/10;
(Continued)

(56) References Cited

U.S. PATENT DOCUMENTS 3,527,901 A 9/1970 Geib
5,343,532 A 8/1994 Shugart et al.
(Continued)

FOREIGN PATENT DOCUMENTS

CN 102006543 4/2011
CN 201830442 5/2011
(Continued)

OTHER PUBLICATIONS

International Search Report for PCT/GB2017/052534 dated Nov. 16, 2017, 5 pages.
(Continued)

*Primary Examiner* — Walter F Briney, III
(74) *Attorney, Agent, or Firm* — Nixon & Vanderhye P.C.

(57) ABSTRACT

An earpiece for an earphone comprising a leading portion, a trailing portion, and a resilient bridge interconnecting the leading portion and trailing portion. The resilient bridge is configured to flex so that the earpiece can conform to ear canal geometry as it is received in a user ear canal and to provide a biasing effect so that the leading portion and/or trailing portion contact the ear canal wall. An actuator to augment low frequency sound is provided on the leading portion.

19 Claims, 9 Drawing Sheets

(52) U.S. Cl.
CPC ..... *H04R 2420/07* (2013.01); *H04R 2460/09* (2013.01); *H04R 2460/13* (2013.01)

(58) Field of Classification Search
CPC ..... H04R 2201/103; H04R 2201/105; H04R 2201/107; H04R 2201/109; H04R 2225/00; H04R 2225/0213; H04R 2225/0216; H04R 2225/023; H04R 2225/025; H04R 2225/77; H04R 2420/07; H04R 2460/09; H04R 2460/13
See application file for complete search history.

(56) References Cited

U.S. PATENT DOCUMENTS

| | | | | |
|---|---|---|---|---|
| 5,420,930 | A | 5/1995 | Shuggat, III | |
| 5,572,594 | A | 11/1996 | Devoe et al. | |
| 7,627,131 | B2 | 12/2009 | Nielsen et al. | |
| 10,757,497 | B2 * | 8/2020 | Austen | H04R 1/1016 |
| 2006/0159298 | A1 | 7/2006 | Von Dombrowski | |
| 2007/0036379 | A1 * | 2/2007 | Anderson | H04R 25/656 381/324 |
| 2009/0103763 | A1 | 4/2009 | Petef et al. | |
| 2009/0123010 | A1 | 5/2009 | Cano et al. | |
| 2010/0222639 | A1 * | 9/2010 | Purcell | H04R 25/606 600/25 |
| 2012/0219168 | A1 | 8/2012 | Zhao et al. | |
| 2013/0051590 | A1 | 2/2013 | Slater | |
| 2014/0169599 | A1 * | 6/2014 | Solum | H04R 25/554 381/315 |
| 2015/0187349 | A1 * | 7/2015 | Schafer | B06B 1/0644 367/189 |

FOREIGN PATENT DOCUMENTS

| | | |
|---|---|---|
| DE | 36 25 891 | 2/1988 |
| EP | 2 930 944 | 10/2015 |
| WO | 96/21334 | 7/1996 |
| WO | 97/11573 | 3/1997 |
| WO | 00/32009 | 6/2000 |
| WO | 00/76271 | 12/2000 |
| WO | 2010/116006 | 10/2010 |
| WO | 2012/130294 | 10/2012 |
| WO | 2014/040649 | 3/2014 |

OTHER PUBLICATIONS

Written Opinion for PCT/GB2017/052534 dated Nov. 16, 2017, 7 pages.

* cited by examiner

EARPIECE WITH ACTUATOR

This application is a Continuation-in-Part of U.S. patent application Ser. No. 16/329,427 filed 28 Feb. 2019, which is the US National Phase of PCT application PCT/GB2017/052534 filed in English on 31 Aug. 2017 claiming priority to GB Application No. 1614883.5 filed on 1 Sep. 2016. The entire contents of these applications are incorporated herein by reference.

FIELD OF THE INVENTION

The present invention relates to an earpiece for an earphone and an earphone system.

BACKGROUND OF THE INVENTION

Earphones can be used in a large range of applications including audio listening, communication technology, physiological sensing, and environmental monitoring. Such earphones typically include an earpiece that is inserted into a user's ear.

Referring to FIG. 1, an ear 1 comprises an outer portion 2, middle portion 3 and inner portion 4. The outer portion comprises an auricle 5 that collects sound waves and guides them along an ear canal 6 to a tympanic membrane 7. A tragus (not shown) protrudes at least partially over the opening of the ear canal. At the middle ear, the sound waves strike the tympanic membrane causing it to vibrate. These vibrations are amplified by the bones of the ossicles 8. Once the amplified vibrations reach the inner ear, they are converted into electrical impulses by a cochlea 9 and sent to the brain via an auditory nerve 10.

As can be seen in FIG. 2, the ear canal 6 is a generally S-shaped tube with a first bend 11 towards the rear of the skull and a second bend 12 towards the front of the skull. The ear canal inclines upwardly, and the narrowest section lies between the first and second bends at an isthmus 13. In an adult, the length of the ear canal is approximately 20-30 mm, the width of the isthmus is approximately 4-7 mm, the height of the isthmus is approximately 6-10 mm and the angle of incline is approximately 24-26°.

Conventional earpieces sit in the auricle of the outer ear, blocking the opening of the ear canal. These earpieces can be ill-fitting and easy to dislodge. Users have found that these earpieces can be uncomfortable to wear and unsightly. The volume of sound produced by the earpieces may need to be adjusted to sufficiently counter ambient noise and prolonged use at this higher volume consumes higher power and may risk damaging a user's hearing. Due to their occlusion of the ear canal, users are also required to remove the earpieces when not in use.

EP2930944 describes a hearing aid device having a receiver, a hearing instrument body and a connectional member between the hearing aid body and the receiver. A connection member has a means for achieving a first stiffness sufficiently large to insert the hearing aid device into an ear canal and a significantly reduced stiffness to allow the hearing aid to be comfortable once inserted. The hearing instrument body is wedged in the isthmus, completely blocking it, likewise the receiver is also wedged in place in the second bend (12 in the accompanying FIG. 2) so is a distance from the tympanic membrane. This is inevitable because the relative inflexibility of the connecting member during insertion does not allow the receiver to be inserted beyond the second bend. It would appear to that the inflexibility of the connecting member during insertion would render the device extremely uncomfortable, or even painful as it past the first bend (11 in FIG. 2) attached)—even in reality it was possible to get the device around the first member into the isthmus (13 in FIG. 2). Once in place, the device of EP 2930944 completely blocks transmission of ambient noise along the ear canal.

WO9621334A1 shows an earpiece connected by an articulated connector joining a receiver module and a main module. Both modules are wedged in the ear canal and block transmission of all ambient noise. Furthermore, the articulated structure of the connecting member limits the insertion of many of the illustrated examples to the second bend. It is also unclear, given the angles of the bends in the ear, whether the device could pass easily into and through the isthmus without causing damage and pain.

The present invention seeks to overcome, or at least mitigate, the problems of the prior art. The present invention seeks to provide an improved earpiece for an earphone, an improved earphone comprising the earpiece and an improved earphone system.

SUMMARY OF INVENTION

According to the present invention an earpiece for an earphone to locatable in the ear canal of a user comprising:

a leading portion locatable beyond the isthmus of the ear canal in proximity to the tympanic membrane of a user;

a trailing portion to be in proximity to the auricle of the user;

a resilient bridge interconnecting the leading portion and trailing portion, arranged to form a V-shape to conform to ear canal geometry as it is received in a user ear canal, the sizes of the leading portion and trailing portion being chosen so as the leading portion and trailing portion do not block the flow of ambient noise directly through the ear canal to the tympanic membrane and the resilient bridge provides a biasing effect to bias the leading portion and/or trailing portion against the ear canal wall;

an actuator carried by the leading portion configured to vibrate the ear canal wall in response to received signals.

The resilient bridge aids the guiding and locating of the earpiece in the ear canal. Due to the resilient bridge, the earpiece has a protean configuration. As a result, the earpiece can change its shape and size whilst being positioned in the ear canal.

By enabling the earpiece to conform to the ear canal geometry as it is received in the ear, the earpiece has a universal fit. It is also comfortable to wear. Moreover, the earpiece does not require moulding prior to fitting.

The earpiece is discreet to wear as it is fully locatable within the ear canal and does not protrude beyond the ear canal. The length of the earpiece is preferably approximately 20 mm or less. Due to its resilience, the resilient bridge can return to its original shape after being flexed.

Preferably, the resilient bridge is configured to be sufficiently resilient to bias at least a part of the leading portion and/or the trailing portion against the ear canal wall as the earpiece is modified to the ear canal profile. Consequently, the bridge also helps retain the earpiece in the ear canal. The bridge may bias the leading portion and trailing portion against opposing ear canal walls.

So as not to occlude the ear canal, the earpiece is preferably configured to form a gap space between the earpiece and ear canal wall when it is fitted. Accordingly, the sound waves of ambient noise can reach a user's tympanic membrane via the gap space in the ear canal and the user need not remove the earpiece to hear ambient noise when required.

The earpiece may comprise one or more operational apparatus carried by the leading portion and/or trailing portion. Operational apparatus may be mounted externally on the leading portion and/or trailing portion. Operational apparatus may be housed internally in one or more cavities formed in the leading portion and/or trailing portion.

The operational apparatus depends on the function of the earphone. The earpiece may comprise operational apparatus to allow for audio listening, communication, physiological sensing, and/or environmental monitoring. To produce sound, the earpiece may comprise a speaker and speaker controller. In an embodiment, the speaker may be mounted in a cavity of the first or trailing portion and the portion may comprise a sound outlet port to project the sound of the speaker towards the tympanic membrane. The speaker controller may be mounted in a cavity of the first or trailing portion and electrically coupled to the speaker via a cable extending through a cavity of the bridge. By positioning the earpiece in the ear canal, closer to the tympanic membrane, the sound producing performance of the earpiece is optimised. The proximity to the tympanic membrane minimises the pathway from the speaker to the tympanic membrane such that extraneous effects are limited, and power consumption is reduced.

To provide sound enhancement and/or counter low frequency leakage in the ear canal, an embodiment of the earpiece may comprise one or more sound enhancers to augment the delivery of low frequency sound signals with frequencies approximately <300 Hz. The one or more sound enhancers may be arranged to extend longitudinally in the leading portion and/or trailing portion, adjacent to the ear canal wall and use a bone conduction effect to directly vibrate the middle ear at low frequencies.

To provide noise cancelling to counter the effects of ambient noise when the earpiece is in use, an embodiment of the earpiece may comprise a microphone to detect ambient noise. Due to its location in the ear canal, the earpiece may comprise an accelerometer to measure the vibration of the user's skull to record a user's voice independent of ambient noise.

By locating the earpiece in the ear canal, physiological factors can be accurately measured from the ear canal wall and/or tympanic membrane. The earpiece may comprise sensors to detect physiological factors of the user such as, for example heart rate, blood oxygen saturation and body temperature.

The leading portion, trailing portion and resilient bridge may be integrally formed or separately formed and coupled together to form a body. The body may be a V-shaped body or an elongate shaped body.

In an embodiment, the leading portion and trailing portion are arranged to meet at the resilient bridge with an acute angle therebetween to form a V-shaped body with a leading end and trailing end. The bridge is arranged to form a vertex at the leading end of the V-shaped body, interconnecting the leading portion and trailing portion. The leading portion extends in a trailing direction from a first end of the bridge. The trailing portion extends in a trailing direction from a second end of the bridge. The bridge can flex to laterally to move the leading portion and trailing portion closer together or further apart and thereby vary the acute angle Ø. As a result, the V-shaped body of the earpiece can adapt to the ear canal geometry. The bridge may be able to flex to vary the acute angle Ø between approximately 0° and 45°.

The V-shaped earpiece may adapt to the ear canal geometry so that the leading end of the body may be positioned inwardly of the ear canal isthmus, adjacent the tympanic membrane. The trailing end of the body may be positioned outwardly of the isthmus and inwardly of the tragus The V-shaped earpiece may comprise a resilient wing extending from the first or trailing portion. The wing may be configured to flex and fold around at least part of the portion when inserting the portion into the ear canal. The configuration of the folded wing helps the earpiece further conform to ear canal geometry and ease the insertion, removal and/or movement of the earpiece along the ear canal. The folded wing may additionally or alternatively bias the earpiece against the ear canal wall.

The V-shaped earpiece may comprise a skirt extending at least partway around the first or trailing portion. The skirt may be configured to bias the earpiece against the ear canal wall and/or provide sound isolation. The skirt may be split to allow its diameter to vary according to ear canal geometry.

In an alternative embodiment, the leading portion, resilient bridge, and trailing portion may be arranged sequentially to form an elongate shaped body with a leading end and a trailing end. The leading portion is a leading portion extending in a leading direction from the bridge. The trailing portion is a trailing portion extending in a trailing direction from the bridge. The bridge can flex to allow for relative lateral and/or vertical movement between the leading portion and the trailing portion. The bridge may be able to flex to allow for relative movement between the leading portion and trailing portion in any direction. Due to the relative movement between the leading portion and trailing portion, the elongate body of the earpiece can adapt to the ear canal geometry as the earpiece proceeds through the ear canal.

The earpiece may adapt to the ear canal geometry so that the leading portion of the elongate earpiece may be positioned inwardly of the ear canal isthmus, adjacent the tympanic membrane. The trailing portion of the elongate earpiece may be positioned outwardly of the isthmus and inwardly of the tragus.

The elongate earpiece may comprise a leading resilient wing extending from the leading portion of the elongate earpiece. The leading wing may be configured to be sufficiently flexible to fold around at least a part of the leading portion when inserting the leading portion in the ear canal. The folded wing eases the insertion, removal and/or passage of the leading portion in the ear canal.

To allow the leading portion to pass through the isthmus of a user's ear canal the combined dimensions of the leading portion and leading resilient wing folded around the leading portion are preferably less than the minimum dimensions of the isthmus. For example, the combined width of the leading portion and thickness of the folded leading wing is less than approximately 4 mm. The combined height of the leading portion and thickness of the folded leading wing is less than approximately 6 mm.

Additionally, or alternatively, the earpiece may comprise a resilient wing extending from the trailing portion of the elongate earpiece. The trailing resilient wing may be configured to flex and fold around at least a part of the trailing portion when inserting the trailing portion in the ear canal. The folded wing eases the insertion, removal and/or passage of the trailing portion in the ear canal.

The resilient wing extending from the trailing portion may act as a stop to help prevent the trailing portion pass through the isthmus. To form the stop, the combined dimensions of the trailing portion and thickness of the trailing resilient wing folded around the leading portion are preferably greater than the maximum dimensions of the isthmus. For example, the combined width of the trailing portion and thickness of the folded trailing wing is greater than approximately 7 mm. The combined height of the trailing portion and thickness of the folded trailing wing is greater than approximately 10 mm. By providing a wing stop, the risk of incorrectly fitting of the earpiece is minimised and earpiece contact with the tympanic membrane is restricted.

The leading and/or trailing resilient wings are preferably sufficiently resilient to apply a biasing force on the ear canal wall that helps to maintain the position of the earpiece in the ear canal.

The elongate earpiece may comprise a trailing skirt extending at least partway around the circumference of the trailing portion. The trailing skirt may be configured to form a stop to help prevent the trailing portion pass through the isthmus. To form the stop, the diameter of the trailing skirt is preferably greater than the maximum dimensions of the isthmus. For example, the diameter of the trailing skirt is greater than approximately 7 mm. Due to the skirt stop, the risks of fitting the earpiece too deeply in the ear canal and damage to the tympanic membrane are avoided.

Alternatively, or additionally, the elongate earpiece may comprise a leading skirt extending at least partway around the circumference of the leading portion.

The trailing and/or leading skirt may be resilient to bias the skirt against the ear canal wall and so help maintain the position of earpiece in the ear canal.

The trailing and/or leading skirt may extend in a trailing direction from the respective portion. The trailing and/or leading skirt may have a frusto-conical shape, with a narrower leading end and a wider trailing end. As a result, the biasing effect of the skirt is optimised. Also, due to its configuration, the skirt can provide sound isolation to minimise loss of any sound produced by the earpiece.

The trailing and/or leading skirt may comprise a split to allow the skirt diameter to vary in accordance with the ear canal geometry.

The earpiece may be combined in operation with an earphone. The earphone may comprise a module mountable behind a user's ear and a connection interconnecting the earpiece and module. The module is preferably configured to house further operational apparatus. The operational apparatus in the module may comprise a power source, data receiving and/or transmitting means, controller, and further sensors. The operational apparatus in the module and earpiece are electrically coupled via the connection.

In another aspect of the invention an earphone system comprising a first and a second earphone, wherein the earpieces, and optionally the modules, of the first and second earphones have reflectional symmetry to one another. Such a system provides a first earphone configured to conform to the geometry of a user's right ear and a second earphone configured to conform to the user's left ear.

The first and second earphones may have a master-slave configuration, wherein the first earphone comprises master operational apparatus and the second earphone comprises slave operational apparatus.

DETAILED DESCRIPTION OF EMBODIMENT(S)

The present invention relates to an earpiece that is configured to be discretely fitted wholly in the ear canal, the earpiece may be part of an earphone system.

Figure 1:
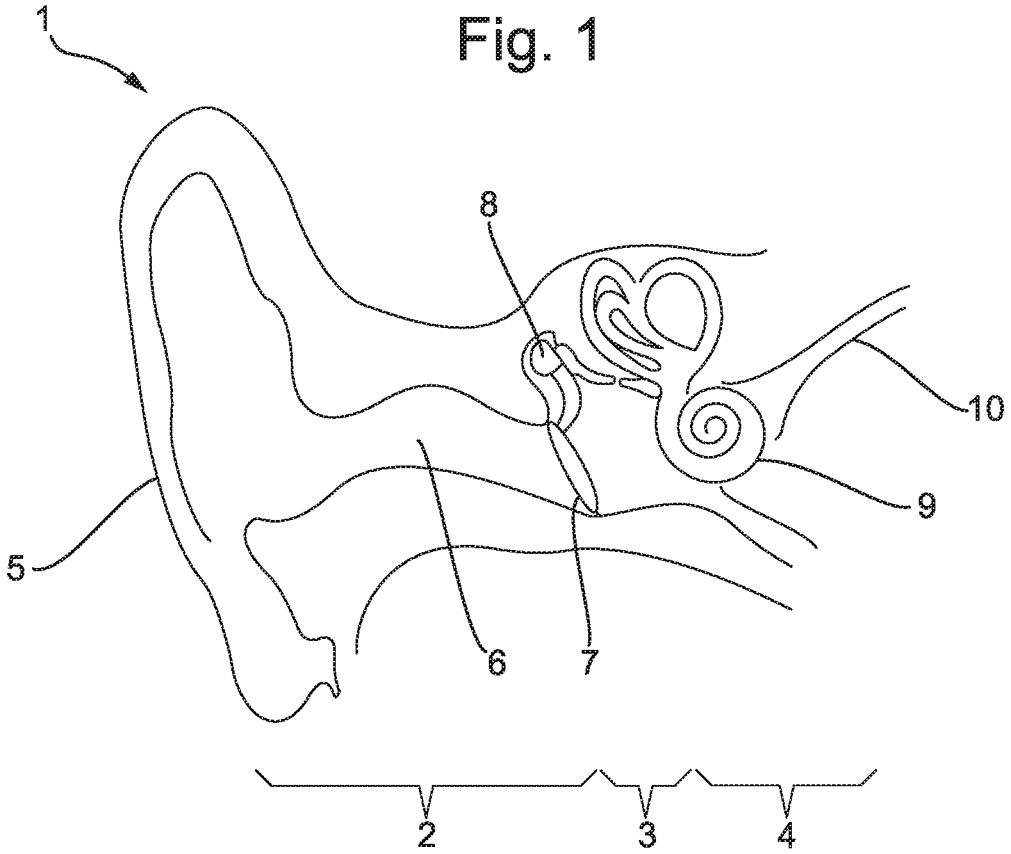
FIG. 1 depicts the anatomy of an ear.
Figure 2:
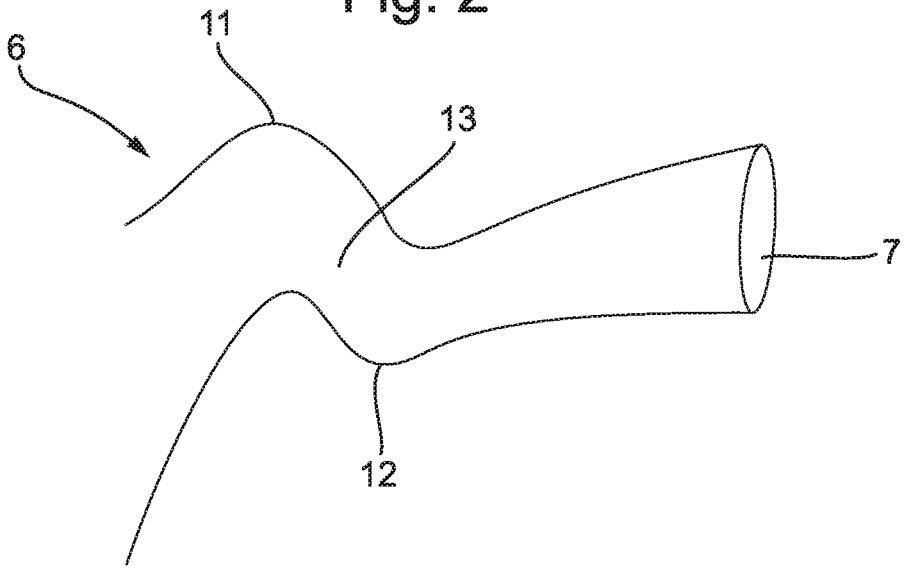
FIG. 2 is a top view of an ear canal.
Figure 3:
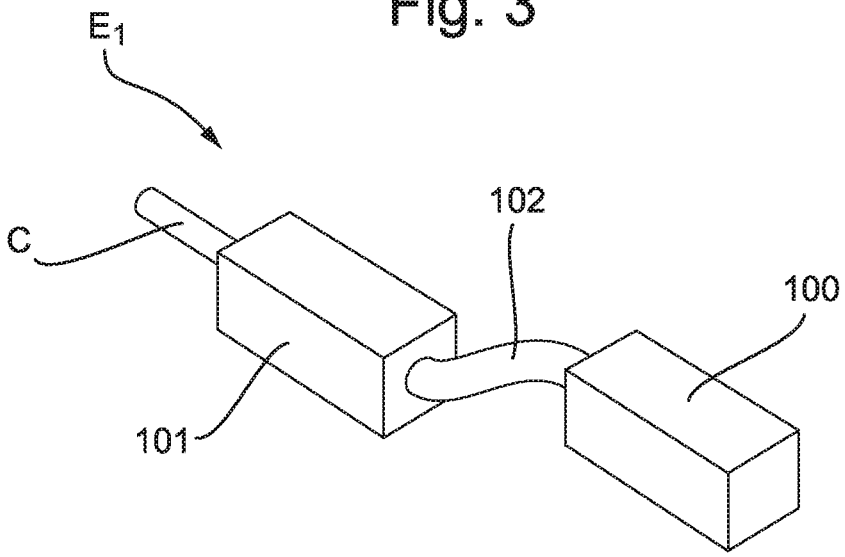
FIG. 3 is a perspective view of a first embodiment of an earpiece according to a first aspect of the present invention with an elongate shaped body.

FIG. 3 depicts a first embodiment of an earpiece in its most simple form. The earpiece $E_1$ has an elongate body. The elongate body comprises a leading portion 100 and a trailing portion 101 interconnected by a resilient bridge 102. The leading portion 100, resilient bridge 102 and trailing portion 101 are arranged sequentially along the length of the elongate earpiece body.

In this context, "leading portion" is that part of the earpiece that fits beyond the isthmus closet to the tympanic membrane and "trailing portion" is that part of the earpiece closest to the auricle.

In FIG. 3, the earpiece body comprises a soft elastomeric material. The body is preferably encapsulated in an antimicrobial silver-ion treated silicon coating to provide waterproofing and biocompatibility.

The leading portion 100 and trailing portion 101 have a generally cuboid or ellipsoid shape. The leading portion 100 and trailing portion 101 are configured to house operational apparatus of the earpiece in one or more internal cavities (not shown). The operational apparatus in the leading portion 100 and trailing portion 101 may be electrically connected by cables extending via a through hole in the bridge 102.

Figure 4:
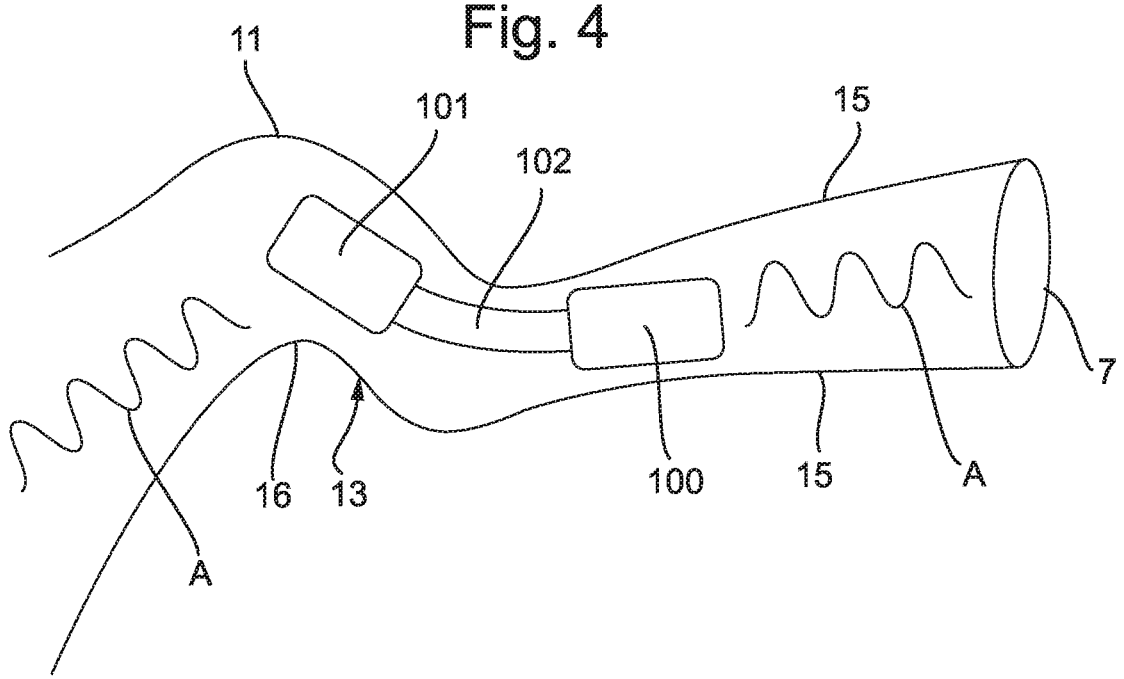
FIG. 4 is a top view of the first embodiment of the earpiece fitted in the ear canal of a user.

The bridge 102 has sufficient flexibility to allow the earpiece to adapt to the geometry of the ear canal and be fully fitted into the ear canal. The bridge is flexible to allow for relative movement between the leading portion and trailing portion. The bridge may be flexible to allow for lateral movement between the leading portion and trailing portion. The bridge may be flexible to allow for vertical movement between the leading portion and trailing portion. Preferably, the bridge is flexible to allow for relative movement in any direction. As shown in FIG. 4, the bridge is able to flex so that the leading portion can travel around the first ear canal bend 11, through the isthmus 13 and be situated inwardly of the isthmus, adjacent to the tympanic membrane 7, whilst the trailing portion is situated outwardly of the isthmus 13.

Due to the bridge, the earpiece can conform to the contours of substantially any ear canal and so it has a universal fit. Also, the earpiece can conform to the ear canal as it progresses along the ear canal and so prior casting of the earpiece is avoided and comfort is optimised.

The bridge has sufficient resilience to bias at least a part of the leading portion and trailing portion against opposing ear canal walls and thereby help retain the earpiece in the ear canal. In FIG. 4, the bridge biases at least a part of the leading portion against an anterior wall 15 of the ear canal and biases at least a part of the trailing portion against a posterior wall 16 of the ear canal. The resilient bridge can at least substantially return to its original configuration when the earpiece is removed from the ear canal.

In this embodiment, the earpiece is configured so as not to seal the ear canal when it is fitted. As a result, ambient sound waves A can travel through a gap space between the earpiece and ear canal wall to the tympanic membrane 7. Thus, the wear-time of the earpiece is extended because the user is still able to hear ambient noise even when the earpiece is fitted in the ear canal.

To improve the insertion, removal and guiding of the earpiece through the ear canal, the leading portion may comprise an inclining or reclining leading face with curved edges.

The earpiece may comprise one or more wings extending from the leading portion and/or the trailing portion.

Figure 5A:
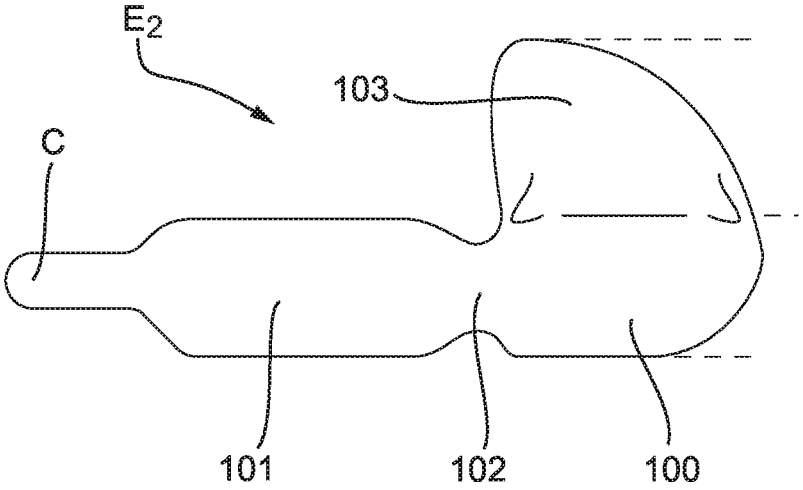
FIG. 5*a* is a side view of a second embodiment of an earpiece according to the first aspect of the present invention with an elongate shaped body and leading wing.
Figure 5B:
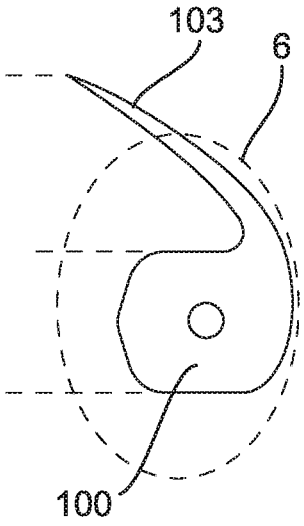
FIG. 5*b* is a front-end view of the second embodiment of the earpiece prior to fitting in an ear canal.

In the second embodiment depicted in FIGS. 5*a* and 5*b*, an earpiece $E_2$ comprises a leading portion 100, resilient bridge 102 and trailing portion 101 arranged sequentially in an elongate body as with the first embodiment and also a leading wing 103 extending from the leading portion 100. The wing extends in a generally tangential direction from a side edge of the leading portion.

Figure 6:
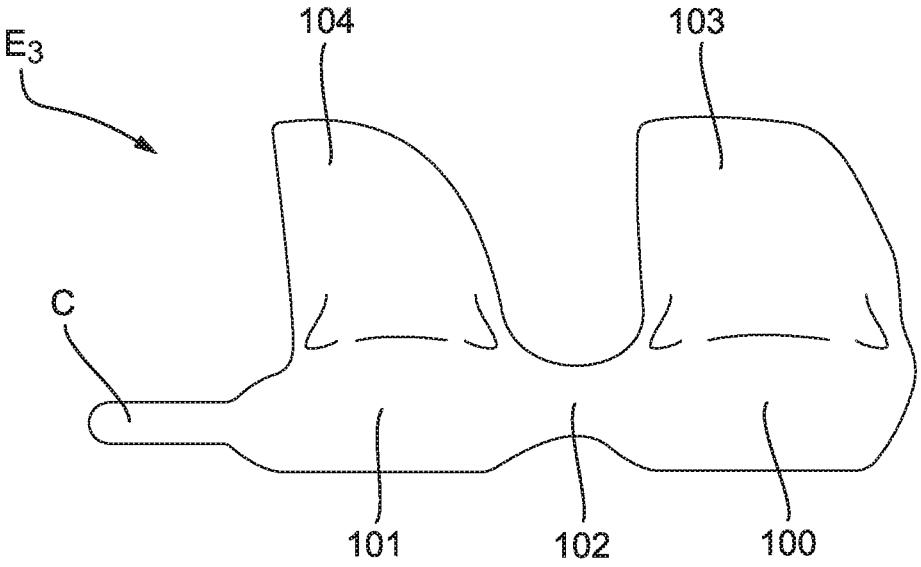
FIG. 6 is a side view of a third embodiment of an earpiece according to the first aspect of the present invention with an elongate shaped body, leading wing, and trailing wing.

In a third embodiment depicted in FIG. 6, an earpiece $E_3$ comprises a leading portion 100, a resilient bridge 102 and a trailing portion 101 arranged sequentially in an elongate body as with the first embodiment, a leading wing 103 extending in a generally tangential direction from a side edge of the leading portion 100 and a trailing wing 104 extending in the same generally tangential direction from a corresponding side edge of the trailing portion. Alternatively, the trailing wing may have mirror symmetry to the leading wing and extend in an opposing tangential direction from an opposing side edge of the trailing portion.

The leading wing and trailing wing have sufficient flexibility to flex and fold around at least part of the circumference of the respective portions when the leading portion and trailing portion are located in the ear canal. The contact area between the wings and ear canal wall distributes pressure to ease the insertion/removal of the wing into the ear canal and help guide the earpiece through the ear canal.

A leading edge of the leading wing preferably has a sweeping configuration to further aid the insertion, removal, or passage of the leading portion into the ear canal.

The combined dimensions of the leading portion and leading wing when folded around the leading portion may be less than minimum dimensions of the isthmus. For example, the combined width of the leading portion and thickness of the folded leading wing is less than approximately 4 mm. The combined height of the leading portion and thickness of the folded leading wing is less than approximately 6 mm. As a result, the leading portion and folded leading wing are small enough to pass through the isthmus and closer to the tympanic membrane as the earpiece is fitted in the ear canal.

The combined dimensions of the trailing portion and trailing wing when folded around the trailing portion may be greater than maximum dimensions of the isthmus. For example, the combined width of the trailing portion and thickness of the folded trailing wing is greater than approximately 7 mm. The combined height of the trailing wing and thickness of the folded trailing wing is greater than approximately 10 mm. As a result, the trailing portion and folded trailing wing are too large to pass through the isthmus and form a stop for the earpiece.

To help retain the earpiece in the ear canal, the leading wing and/or trailing wing have sufficient resilience to provide a biasing effect on the canal wall.

Preferably, the leading wing and/or trailing wing are configured so as not to seal the ear canal. Hence, the user is still able to hear ambient noise even when the earpiece is fitted in the ear canal.

The earpiece may comprise at least one trailing skirt configured to extend at least substantially around the circumference of the trailing portion.

Additionally, or alternatively, the earpiece may comprise at least one leading skirt configured to extend at least substantially around the circumference of the leading portion.

Preferably, the trailing skirt and/or leading skirt is resilient to provide a biasing effect to help retain the earpiece in position within the ear canal.

The trailing skirt and/or leading skirt may also provide a sound isolating effect to help prevent ambient noise from reaching the tympanic membrane.

In a fourth embodiment depicted in FIGS. 7*a* to 8*c* an earpiece $E_4$ comprises a leading portion 100, resilient bridge 102 and trailing portion 101 arranged sequentially in an elongate body as with the first embodiment, a leading wing 103 extending tangentially from the leading portion 100 and two trailing skirts 105 fully encircling the trailing portion 101. The trailing skirts have a frusto-conical shape, widening in the trailing direction.

Figure 7A:
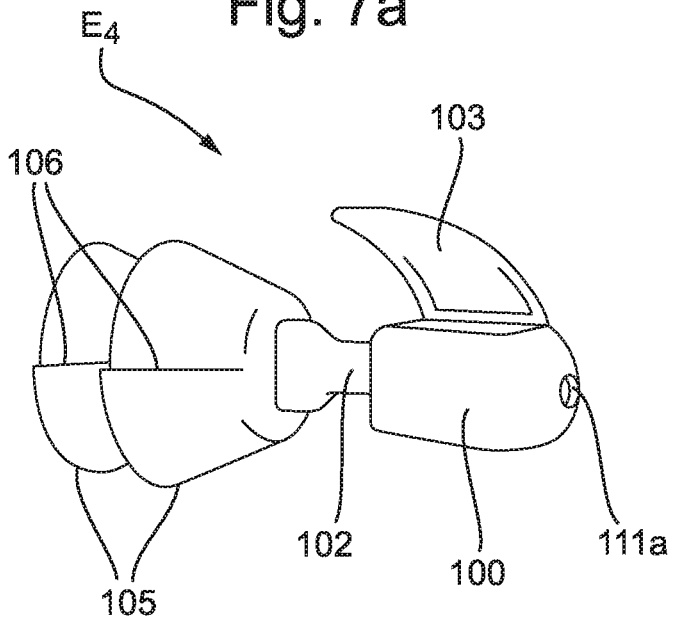
FIG. 7*a* is a side view of a fourth embodiment of an earpiece according to the first aspect of the present invention with an elongate shaped body, a leading wing and two trailing skirts.
Figure 7B:
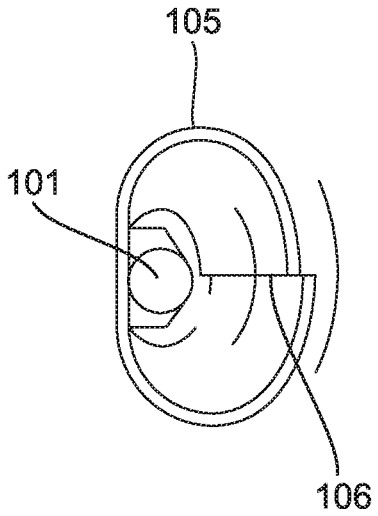
FIG. 7*b* is a rear end view of the fourth embodiment of earpiece.

Each trailing skirt comprises a split 106 to allow the skirt to vary in diameter. Due to the splits, each trailing skirt may overlap and narrow or expand and widen depending on the profile of the ear canal as shown in FIG. 7*b*. As a result, the biasing effect and sound isolating effect of the skirts is optimised.

The minimum diameter of the trailing skirt is greater than the dimensions of the isthmus to form a stop that prevents the trailing portion from passing through the isthmus.

Figure 8A:
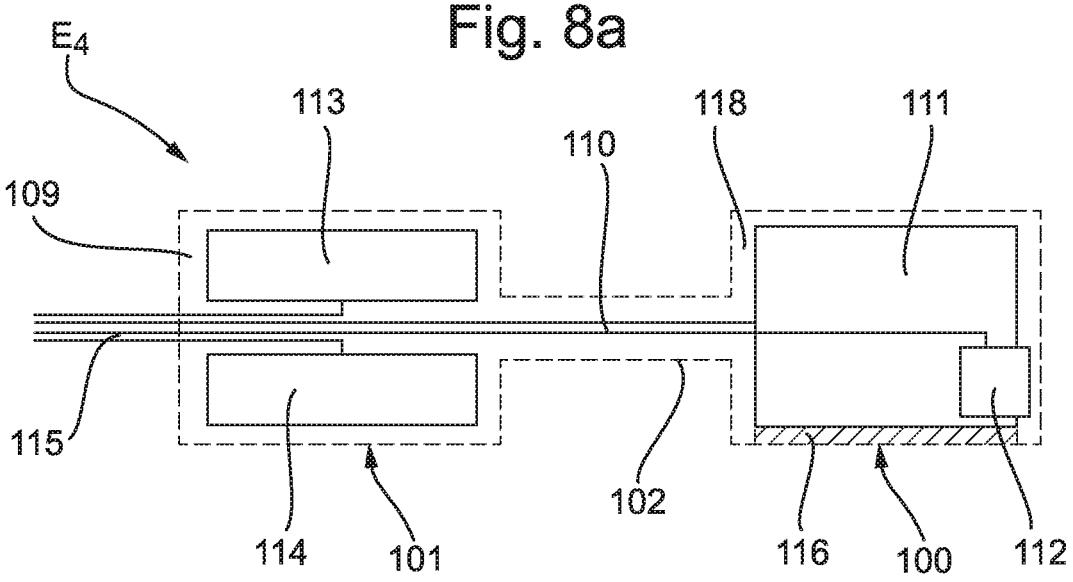
FIG. 8*a* is a schematic showing operational apparatus housed in the fourth embodiment of the earpiece.

As shown in FIG. 8*a*, both the leading portion 100 and trailing portion 101 have an internal cavity 108, 109 in which operational apparatus of the earpiece can be housed. The bridge 102 comprises a through hole 110 to allow cabling to extend to the operational apparatus in the leading portion.

The operational apparatus of the earpiece depends on the desired function of the earphone. The operational apparatus may comprise any suitable means for sound production, communication, recording, physiological sensing and/or environmental monitoring.

Figure 8B:
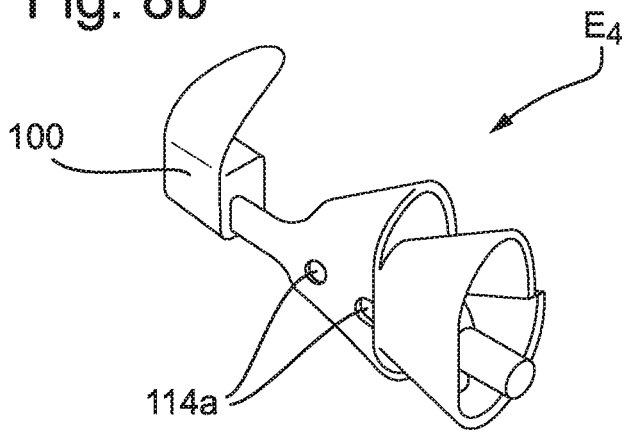
FIGS. 8*b* and 8*c* are perspective views of the fourth embodiment of the earpiece showing ports for the microphone and heart monitor.
Figure 8C:
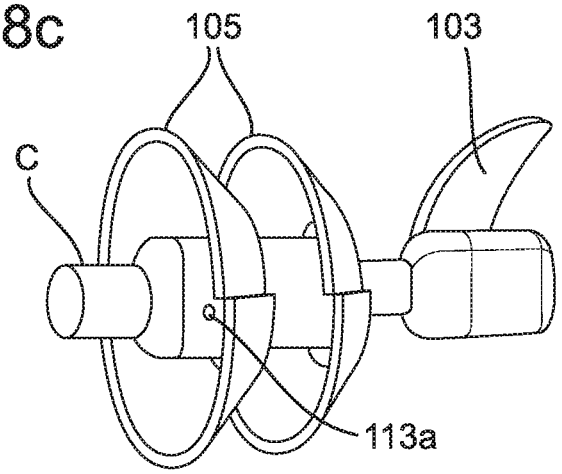

As shown in FIGS. 8*a* to 8*c*, the fourth embodiment of the earpiece E4 comprises a speaker 111 (e.g. a balanced armature driver) and associated outlet port 111*a* to project sound towards the tympanic membrane, a thermometer 112 to detect user temperature from the tympanic membrane or ear canal wall, a MEMS microphone 113 and associated inlet port 113*a* to detect ambient noise as part of a noise cancelling solution and a photoplethysmograph (PPG) heart rate monitor 114 and associated sensing ports 114*a* to detect a user heart rate. Power and electronic signals are transmitted to the operational apparatus of the earpiece via cables 115. The cables extend to the earpiece via connector C.

To provide sound enhancement and/or counter the leakage of low frequency sound in the ear canal (frequencies approximately <300 Hz), the earpiece $E_4$ may comprise a piezoelectric actuator 116 to directly vibrate the middle ear so as to provide low frequency augmentation. The piezoelectric actuator may extend longitudinally in the leading portion such that it lies adjacent to the ear canal wall when the earpiece is fitted in the ear canal. As a result, the actuator 116 may easily vibrate the ear canal wall and use a bone conduction effect to directly stimulate the middle ear at low frequencies.

Figure 9A:
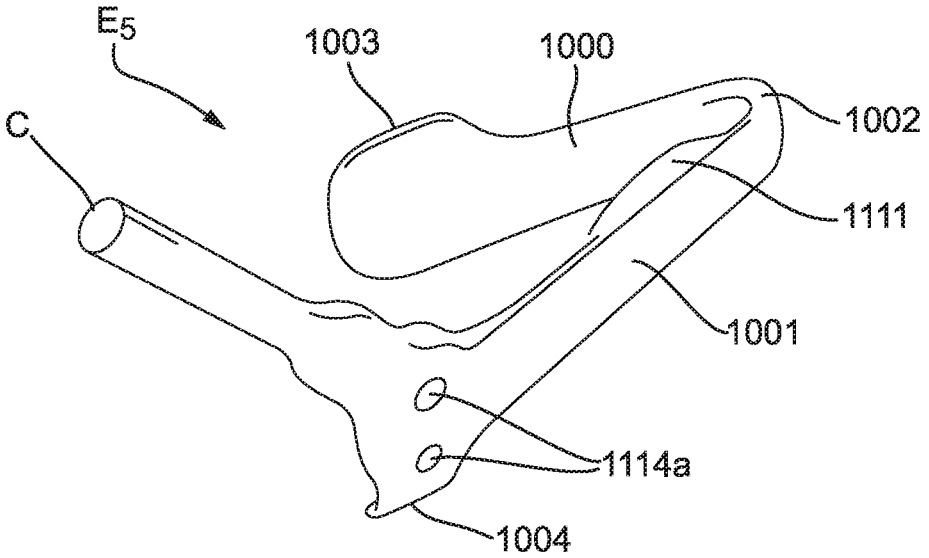
FIG. 9*a* is a perspective view of a fifth embodiment of the earpiece according to the first aspect of the present invention with a V-shaped body.
Figure 9B:
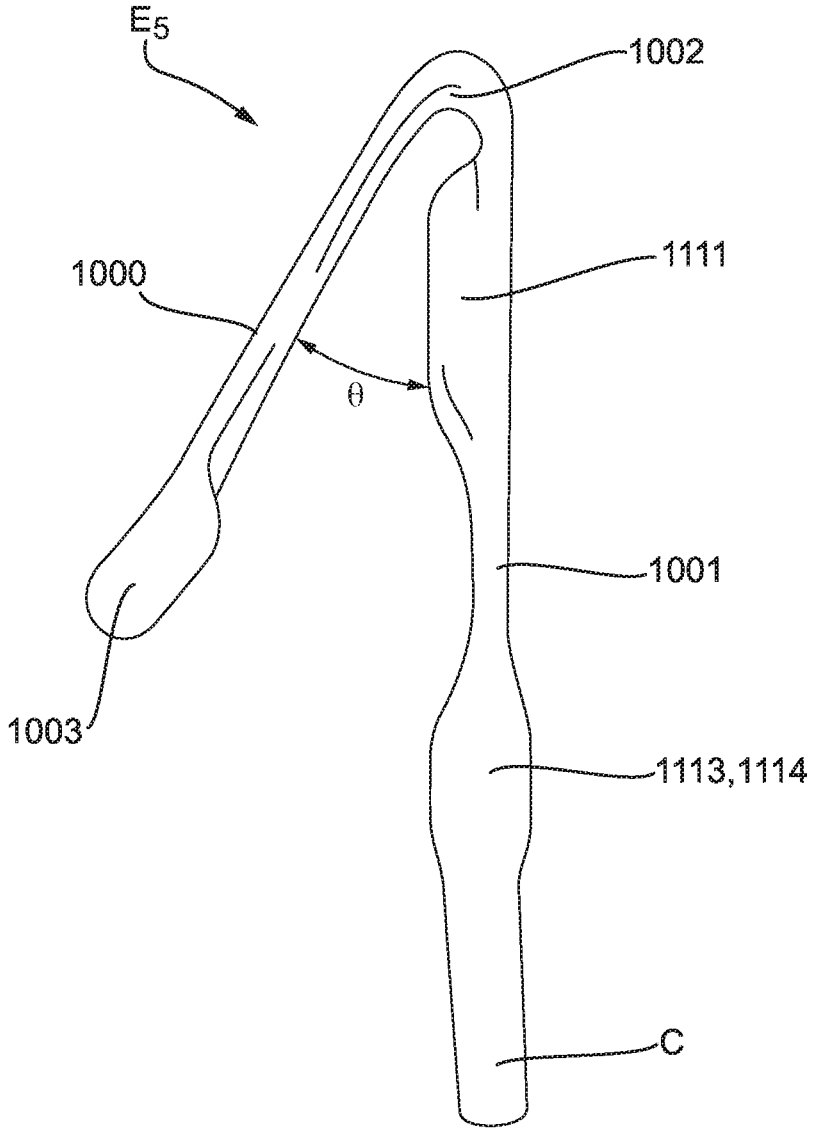
FIG. 9*b* is a top view of the fifth embodiment of the earpiece.

FIGS. 9*a* and 9*b* depict a fifth embodiment of the earpiece $E_5$ where the leading portion 1000, and trailing portion 1001 and resilient bridge 1002 are arranged to form a generally V-shaped body with a leading end and trailing end. The earpiece is configured to conform and be fully locatable in a user's ear canal. The leading end of the V-shaped body is configured to be positioned inwardly of the ear canal isthmus adjacent the tympanic membrane. The trailing end of the V-shaped body is configured to be positioned outwardly of the isthmus within the ear canal.

The V-shaped body comprises a soft elastomeric material. The body is preferably encapsulated in an antimicrobial silver-ion treated coating to provide waterproofing and biocompatibility.

As can be seen in FIGS. 9*a* and 9*b*, the resilient bridge 1002 forms the vertex at the leading end of the body, interconnecting the leading portion and trailing portion. The leading portion and trailing portion extend in a trailing direction from opposing ends of the resilient bridge with an acute angle Ø therebetween. In this embodiment, the original acute angle Ø is approximately 45° prior to earpiece use.

The bridge has sufficient flexibility to allow for flexing movement between the leading portion and trailing portion so that the earpiece can modify its V-shaped profile according to the ear canal geometry. The bridge allows for lateral relative movement between the leading portion and trailing portion to vary the acute angle Ø. Depending on the ear canal geometry, the leading portion and trailing portion can be forced closer together to reduce the acute angle Ø and expand further apart to increase the acute angle Ø. In this embodiment, the bridge is configured to allow the first and trailing portions close to a minimum acute angle Ø of approximately 0° and open to a maximum acute angle Ø of approximately 45°.

Due to the bridge, the angle between the first and trailing portions can vary so that the earpiece is able to conform to any ear canal geometry and so it has a universal fit. Also, the configuration of the earpiece can adapt as it is fitted in the ear canal and so prior casting of the ear piece is not required. A user may initially compress the leading portion and trailing portion together when inserting the earpiece into the ear canal. After the user releases the first and trailing portion the bridge will flex to vary the angled position of the leading portion and trailing portion according to ear canal geometry. In the embodiment, the bridge also has sufficient resilience to bias the trailing ends of the leading portion and trailing portion against opposing ear canal walls when located in the ear canal.

Operational apparatus is housed within internal cavities of the first and trailing portions of the earpiece. As with the elongate embodiments of the earpiece, the operational apparatus may comprise any suitable apparatus depending on the desired function of the earphone. In the embodiment shown in FIGS. 9*a* and 9*b*, the V-shaped earpiece comprises a speaker 1111 (e.g. a balanced armature driver) and associated outlet ports (not shown) housed towards the leading end of the trailing portion 1001. The outlet ports are arranged on the inside surface of the trailing portion 1001 to project sound towards the tympanic membrane and protect them from fluid within the ear canal. A thermometer 1112 (not shown) is housed in the leading portion 1000 to detect user temperature from the tympanic membrane or canal wall. A MEMS ambient noise microphone 1113 and PPG heart rate monitor 1114, together with associated sensing ports 1114*a* are arranged towards the trailing end of the trailing portion 1001. A first low frequency piezoelectric actuator (not shown) extends longitudinally and substantially along the length of the leading portion 1000. A second low frequency piezoelectric actuator (not shown) also extends longitudinally and substantially along the length of the trailing portion 1001. When the earpiece is fitted in a user's ear canal, the actuators are arranged adjacent to the ear canal wall so that they can directly vibrate the ear canal to augment low frequency sound signals (approximately <300 Hz) and thereby provide sound enhancement and/or offset low frequency leakage in the ear canal. Power and electronic signals are transmitted to the operational apparatus via cables extending to the earpiece through connector C. The bridge comprises a through hole (not shown) to allow cables extend to the operational apparatus in the leading portion.

To aid the insertion, removal, passage and retention of the earpiece in the ear canal, the earpiece depicted in FIGS. 9*a* and 9*b* comprises a first resilient wing 1003 extending in a generally tangential direction from an upper edge at the trailing end of the leading portion 1000 and a second resilient wing 1004 extending in a generally tangential direction from a lower edge at the trailing end of the trailing portion 1001. The wings have mirror symmetry. The wings have sufficient flexibility to fold around at least part of the circumference of the respective portions when the earpiece is located in the ear canal. The contact area between the wings and the ear canal walls helps to distribute pressure. The combined dimensions of the portions and folded wings is greater than the dimensions of the isthmus and so they form a stop at the trailing end of the earpiece. The wings have sufficient resilience to provide an additional biasing effect on the ear canal walls.

The earpiece depicted in FIGS. 9*a* and 9*b* is configured to form a gap space between the V-shaped body and ear canal walls when it is fully located in a user's ear canal. As a result, a user can hear ambient noise when the earpiece speaker is not in use. However, the earpiece may additionally include a skirt extending around the first and trailing portions to bias against the ear canal wall and provide sound isolation. The skirt may have any of the features of the skirts as described previously with the elongate earpiece embodiments. The skirt may comprise a split to allow the diameter of the skirt to vary.

Figure 10:
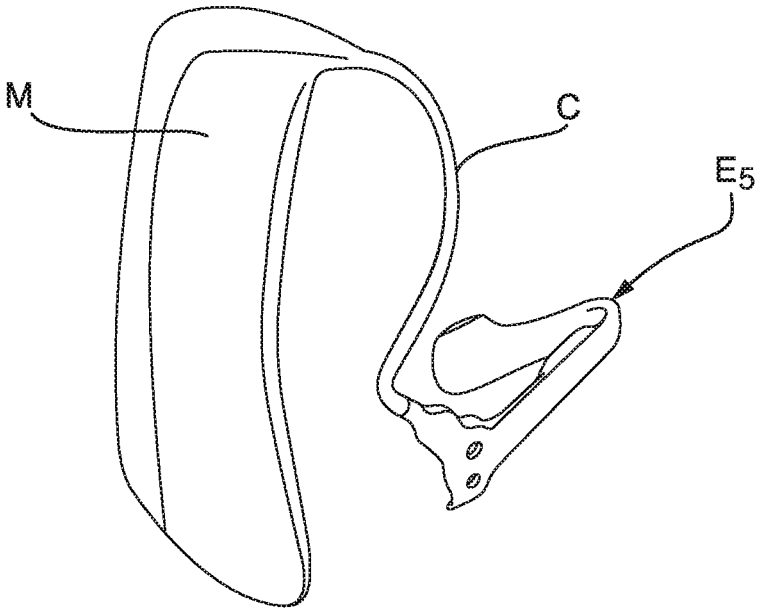
FIG. 10 is a perspective view of a first embodiment of an earphone according to a second aspect of the present invention.
Figure 11:
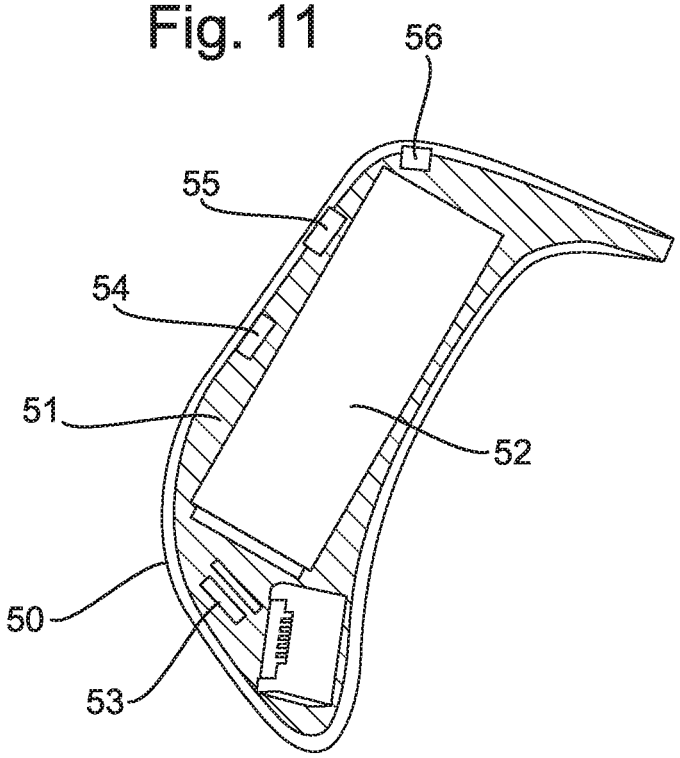
FIG. 11 is an internal view of the module of the first embodiment of the earphone.

A second aspect of the invention relates to an earphone comprising the earpiece. As shown in FIGS. 10 and 11, an embodiment of the earphone comprises the fifth embodiment of an earpiece E5, a module M mountable behind the ear of a user and a connector C electrically connecting the earpiece and module.

In the embodiment depicted in FIGS. 10 and 11, the module comprises a body 50 configured to conform to the rear portion of a user's ear. The body comprises a shell defining an interior cavity 51 for housing operational apparatus.

The operational apparatus housed in the module depends on the function of the earphone. Generally, the operational apparatus comprises a power supply, data receiving and/or transmission means using any suitable wired or wireless communications protocol, controller, and further sensors. In the embodiment depicted in FIG. 11, the operational apparatus housed in the module comprises a rechargeable battery 52 to provide power, a microprocessor 53 to control the operation of the earphone, a first antenna 54 to wirelessly receive and transmit data, such as music, conversation etc, via Bluetooth communication protocol, an inertial sensor 55 to determine a user's head orientation and motion, and a gesture sensor 56 to allow the user to activate the earphone.

The inertial sensor may comprise an accelerometer, gyroscope, and magnetometer to detect a user's head orientation and motion.

The module may comprise a second antenna to allow for wireless data receiving and/or transmission between other earphones.

The connector C for interconnecting the module and the earpiece may comprise a semirigid tube through which power and signal cables may extend from the operational apparatus in the module and operational apparatus in the earpiece.

Figure 12:
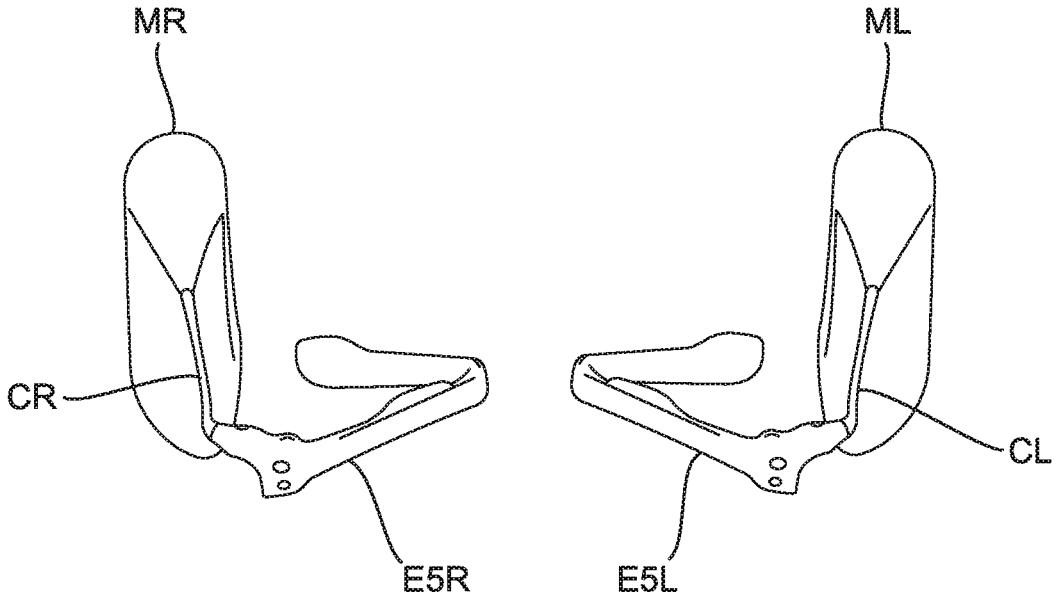
FIG. 12 is first embodiment of an earphone system according to a third aspect of the present invention.

A third aspect of the invention may comprise an earphone system comprising a first earphone for the right ear MR, CR, E5R and second earphone for the left ear ML, CL, E5L as shown in FIG. 12. The pair of earphones preferably have mirror symmetry so that they conform to the right ear and left ear of a user. The pair of earphones may have a master-slave configuration. As a result, the function of the master-slave earphones may be different. For example, the module of the master earphone may have a first antenna to receive and transmit external data from/to an external device via a communications protocol such as Bluetooth. The module of the master earphone may also have a second antenna to control data transfer between the master and slave earphones via a communications protocol such as Bluetooth, ZigBee, PurePath. The earpieces of the earphones may sense different physiological factors of a user and/or environmental factors.

Figure 13:
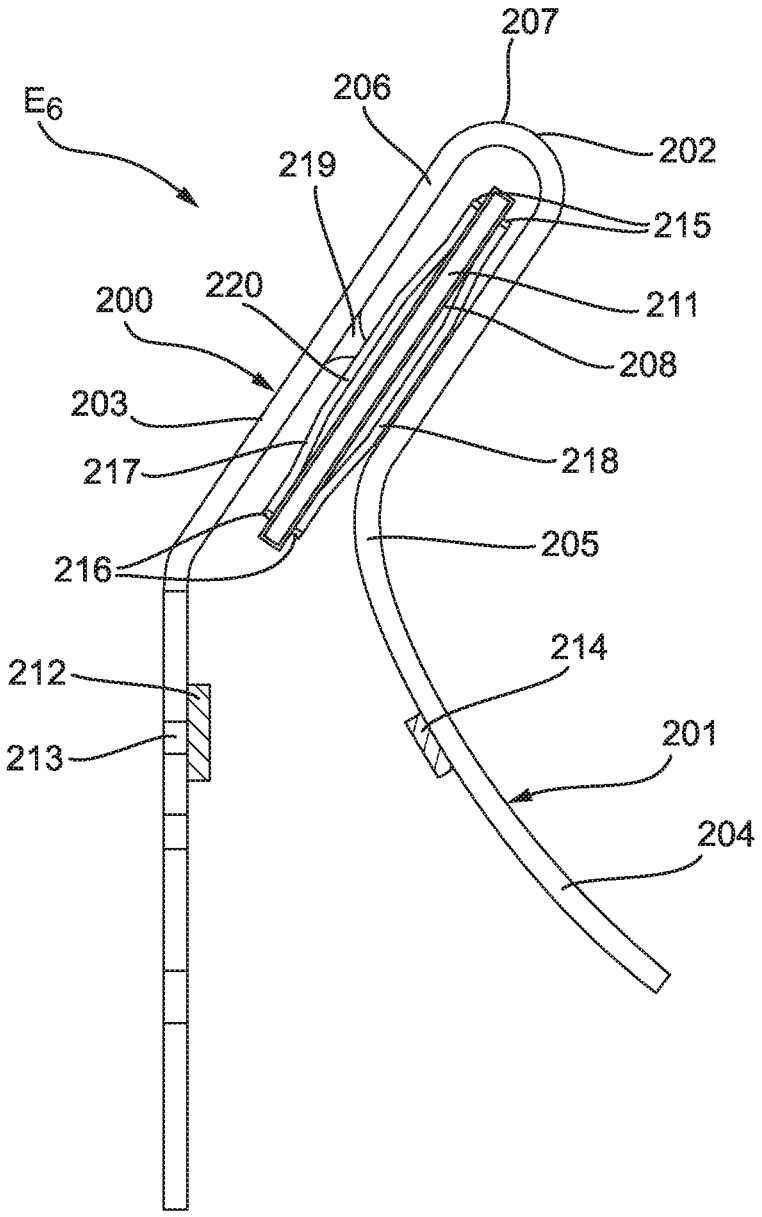
FIG. 13 is a schematic cross-section of a sixth embodiment of the invention.

FIG. 13 illustrates a sixth embodiment of an earpiece $E_6$. The earpiece comprises a leading portion 200 and a trailing potion 201 in an inverted V-configuration with an angle 205 between the leading portion 200 and the trailing portion 201.

The earpiece $E_6$ has a substrate 206, which is square or rectangular in cross-section square or rectangular cross section made of thin metal or other resilient material, typically stainless steel, bent at an apex 202 to from two arms 203 and 204. Typical dimensions of the substrate are depth 3 mm (i.e. across the cross section shown in FIG. 13), width 3 to 5 mm (orthogonal to the cross section in FIG. 13). The substrate thus has an appearance of a hairclip bent at the angle 205. The overall length is the earpiece of FIG. 13 is typically 12 to 18 mm, easily fitting in length of an ear canal.

The arms 203 and 204 are parallel to each other in the leading portion of the earpiece, but diverge in the trailing potion to ensure good engagement against the wall of the ear canal The substrate is coated with an epoxy of polymer material 207 to protect the substrate and to soften the substrate's feel to the ear canal.

The size, shape and configuration of the substrate enables external sound to reach the tympanic membrane of a user directly without obstruction.

The arms 203 and 204 engage against the walls of the ear canal. The substrate 202 is resilient and confirms to the ear canal shape. A low frequency piezoelectric actuator 208, with one or more high frequency piezoelectric speaker layers 211 is held in the leading portion of the earpiece between the ends 215 and 216 of leaf-springs 217 and 218. These members transmit low frequency sound augmented by the piezoelectric actuator 208 to the ear canal wall. A more modern single layer piezoelectric device can replace the low frequency actuator 208 and the higher frequency speaker 211, to cover the whole sound band width of interest.

A stud 219 mounted in the leading portion 200 bears against a hollow or small hole 220 in leaf-spring 218, ensuring that the other cymbal-like member 217 bears against the substrate in close proximity to angle 205. This introduces a mechanical advantage at the extremities of the earpiece where it most firmly contacts the ear canal body.

In the trailing portion 201, a heart rate monitor 212 is mounted adjacent a hole 213 in the arm 203 and a body temperature sensor 214 is mounted on the other arm 204. In addition, an orientation sensor may be mounted in one or other of the arms 203 and 204 or combined with the temperature sensor module. These additional modules are a particularly useful addition to enable remote monitoring of vulnerable people wearing the earpiece.

For clarity, for interconnecting the module such as that shown in the figures and the earpiece may comprise a semi-rigid tube through which power and signal cables may extend from the operational apparatus in module such as shown in FIG. 11 to the piezoelectric actuator 208, and any additional modules such as the pulse rate module 212, temperature monitor 214 and any orientation module.

Throughout the description and claims of this specification, the words "comprise" and "contain" and variations of the word, for example "comprising" and "comprises", means "including, but not limited to", and it is not intended to (and does not) exclude other moieties, components, integers or steps.

Throughout the description and claims of this specification, the singular encompasses the plural unless the context otherwise requires. Where the indefinite article is used, the specification is to be understood as contemplating plurality as well as singularity, unless the context requires otherwise.

Features, integers, characteristics, or compounds described in conjunction with an aspect, embodiment or example of the invention are to be understood as be applicable to any other aspect, embodiment or example described herein unless incompatible therewith.

The invention claimed is:

1. An earpiece for an earphone to locatable in the ear canal of a user comprising:

a leading portion locatable beyond the isthmus of the ear canal in proximity to the tympanic membrane of a user;

a trailing portion to be in proximity to the auricle of the user;

a resilient bridge interconnecting the leading portion and the trailing portion, arranged to form a V-shape to conform to ear canal geometry as it is received in a user ear canal, the sizes of the leading portion and trailing portion being chosen so as the leading portion and the trailing portion do not block the flow of ambient noise directly through the ear canal to the tympanic membrane and the resilient bridge provides a biasing effect to bias the leading portion and/or trailing portion against the ear canal wall;

an actuator carried by the leading portion configured to vibrate the ear canal wall in response to received signals.

2. The earpiece of claim 1 wherein the actuator configured to vibrate the ear canal wall at a low frequency comprises a piezoelectric actuator.

3. The earpiece of claim 2 wherein the piezoelectric actuator also acts as a speaker.

4. The earpiece according of claim 1 wherein the earpiece further comprises a resilient wing extending tangentially from the trailing portion, the wing being configured to flex and fold around at least a part of the trailing portion and/or bias against the ear canal wall, and the wing dimension being chosen to prevent passage of the trailing portion into the isthmus.

5. The earpiece of claim 1 comprising a resilient wing extending tangentially from the leading portion wherein the leading wing is configured to flex and fold around at least a part of the leading portion and/or bias against the ear canal wall.

6. The earpiece of claim 1 wherein the earpiece further comprises at least one frusto-conical resilient skirt extending at least partway around the trailing portion, the skirt tapering towards the isthmus, the skirt being configured to bias against the ear canal wall and forming a stop to inhibit the trailing portion from passing through the isthmus, the skirt comprising a split to allow the diameter of the skirt to vary according to ear canal geometry and to allow ambient noise to pass along the ear canal.

7. The earpiece of claim 1 wherein the earpiece is connected to a module configured to carry operational apparatus and mountable behind a user ear, a connector extending between the module and earpiece to electrically couple operational apparatus in the module and the earpiece.

8. The earpiece of claim 7 wherein the operational apparatus carried by the module comprises wireless data receiving and/or transmitting means.

9. An earpiece according to claim 1 wherein the earpiece comprises at least one of a microphone to detect ambient noise in the ear canal; a physiological sensor; and an environmental monitor.

10. An earpiece of claim 1 being one of a pair of earpieces, a first of the pair of earpieces configured for a user right ear and the second earpiece configured for a user left ear.

11. The earpiece of claim 10, in which the pair of earpieces have a master-slave configuration.

12. The earpiece of claim 1 having a hollow body comprising a stainless-steel substrate coated externally with an elastomer or polymer.

13. An earpiece for an earphone to locatable in the ear canal of a user comprising:

a leading portion locatable beyond the isthmus of the ear canal in proximity to the tympanic membrane of a user;

a trailing portion to be in proximity to the auricle of the user;

a resilient bridge interconnecting the leading portion and the trailing portion, arranged to form a V-shape to conform to ear canal geometry as it is received in a user ear canal, the sizes of the leading portion and trailing portion being chosen so as the leading portion and the trailing portion do not block the flow of ambient noise directly through the ear canal to the tympanic membrane and the resilient bridge provides a biasing effect to bias the leading portion and/or trailing portion against the ear canal wall;

an actuator carried by the leading portion configured to vibrate the ear canal wall in response to received signals;

wherein the actuator is mounted between the ends of a pair of leaf spring members, at least one of the leaf spring members being biased to contact the ear canal wall.

14. The earpiece of claim 13 wherein the said leaf spring members are biased to contact the ear canal wall in close proximity to the angle of the V-shape.

15. The earpiece of claim 14 comprising a hollow body comprising a stainless-steel substrate coated externally with an elastomer or polymer.

16. An earpiece for an earphone locatable in an ear canal of a user comprising:

a resilient substrate comprising two arms having rectangular or square cross section bent around an apex to form a leading portion, the arms being substantially parallel in the leading portion, and further bent at an angle to form a trailing portion with the arms diverging, the leading portion locatable beyond an isthmus of the ear canal in proximity to a tympanic membrane of a user; a trailing portion configured to be in proximity to an auricle of the user, and to conform to ear canal geometry as it is received in a user ear canal;

a piezoelectric actuator mounted between a pair of opposed leaf springs between the arms in the leading portion, at least of the leaf springs bearing on one of the arms to transmit vibration of the piezoelectric actuator to the arm and from the arm to the wall of the ear canal of the user.

17. The earpiece of claim 16 further comprising a stud configured to bear against one of the pair of leaf springs biasing the other of the pair to bear against the arm.

18. The earpiece of claim 16 wherein the piezoelectric actuator is supported between the ends of the pair of leaf springs.

19. The earpiece of claim 16 additionally comprising one or more of a heart rate monitor, body temperature monitor, and an orientation monitor amounted on the arms in the trailing portion.

* * * * *